US007365263B2

(12) United States Patent
Schwartz

(10) Patent No.: US 7,365,263 B2
(45) Date of Patent: Apr. 29, 2008

(54) INTONATION TRAINING DEVICE

(76) Inventor: Richard A. Schwartz, 202 Robbins St., #2, Waltham, MA (US) 02453

( * ) Notice: Subject to any disclaimer, the term of this patent is extended or adjusted under 35 U.S.C. 154(b) by 201 days.

(21) Appl. No.: 10/848,423

(22) Filed: May 18, 2004

(65) Prior Publication Data

US 2004/0231496 A1 Nov. 25, 2004

Related U.S. Application Data

(60) Provisional application No. 60/471,668, filed on May 19, 2003.

(51) Int. Cl.
*G10H 1/38* (2006.01)

(52) U.S. Cl. ..... 84/637; 84/454; 84/477 R; 84/485 R; 84/609; 84/613; 84/672; 84/675

(58) Field of Classification Search ..... 84/637, 84/615, 454, 477 R, 609, 672, 485 R, 675, 84/613

See application file for complete search history.

(56) References Cited

U.S. PATENT DOCUMENTS 3,871,261 A * 3/1975 Wells et al. ..... 84/672
4,152,964 A * 5/1979 Waage ..... 84/675

(Continued)

OTHER PUBLICATIONS

Peterson Tuners, V-SAM Virtual-Strobe Tuner/Audio Tone/Metronome Rhythm, Index, Overview and Instruction Manual, Peterson Electro-Musical Products, Inc., Revised Mar. 2003, www.petersontuners.com.*

(Continued)

*Primary Examiner*—Lincoln Donovan
*Assistant Examiner*—Christina Russell
(74) *Attorney, Agent, or Firm*—Gordon E. Nelson

(57) ABSTRACT

An intonation training device for training musicians in just intonation. As disclosed, the device is a pocket-sized portable device with an audio output and a user interface which includes an LCD display and a device such as a push button for selecting an item from a menu. When the device is turned on, the LCD display indicates a key and the device emits a sustained pure chord in the key. In a preferred embodiment, the pure chord is a perfect fifth in the just scale for the key. To train his or her intonation, the user then plays a sequence of notes in the key, adjusting his or her intonation while playing to eliminate beats between the note being played and the chord being emitted by the training device. In other embodiments, the device may emit a third in the just scale for the key. The user can use the menu item selection device to select another key and the training device then continuously emits the chord in the just scale for that key. The selected key appears in the LCD display.

The user interface permits specification of many modifications of the chord emitted by the training device. The chord may be augmented or diminished, major or minor, may include additional intervals, may have timbres ranging from dark to bright, may be sounded in one of a number of octaves, and may be calibrated to a number of different concert "A"s. The modifications are selected from lists and the currently-selected modification is visible in the LCD.

Implementations disclosed include an implementation that employs stored samples of the chords, an implementation in which the chords are generated from waveforms, and an implementation in a portable pocket-sized multimedia asset player.

22 Claims, 8 Drawing Sheets

U.S. PATENT DOCUMENTS 4,178,823 A * 12/1979 McCoskey et al. ..... 84/672
4,213,372 A * 7/1980 Sasaki et al. ..... 84/470 R
4,248,119 A * 2/1981 Yamada ..... 84/637
4,412,473 A * 11/1983 Laflamme ..... 84/485 R
4,428,269 A * 1/1984 Bione et al. ..... 84/669
4,434,696 A * 3/1984 Conviser ..... 84/675
4,498,363 A * 2/1985 Shimada et al. ..... 84/678
4,523,506 A * 6/1985 Hollimon ..... 84/454
4,763,558 A * 8/1988 Johnson, Jr. ..... 84/485 R
4,860,624 A * 8/1989 Dinnan et al. ..... 84/613
5,287,789 A * 2/1994 Zimmerman ..... 84/477 R
5,302,776 A * 4/1994 Jeon et al. ..... 84/613
5,319,152 A * 6/1994 Konishi ..... 84/637
5,388,496 A * 2/1995 Miller et al. ..... 84/454
5,396,827 A * 3/1995 Miller et al. ..... 84/454
5,442,129 A * 8/1995 Mohrlok et al. ..... 84/637
5,501,130 A * 3/1996 Gannon et al. ..... 84/454
5,639,977 A * 6/1997 Hesnan ..... 84/477 R
5,736,661 A * 4/1998 Armstrong ..... 84/454
5,777,248 A * 7/1998 Campbell ..... 84/454
5,877,443 A * 3/1999 Arends et al. ..... 84/454
5,973,252 A * 10/1999 Hildebrand ..... 84/603
6,080,925 A * 6/2000 Rogers et al. ..... 84/485 R
6,121,529 A * 9/2000 Nakata et al. ..... 84/477 R
6,414,229 B1 * 7/2002 Gaudet ..... 84/465
6,441,289 B1 * 8/2002 Shinsky ..... 84/464 R
6,580,024 B2 * 6/2003 Skubic ..... 84/477 R
6,703,549 B1 * 3/2004 Nishimoto et al. ..... 84/609
6,924,426 B2 * 8/2005 Clynes ..... 84/609
7,196,260 B2 * 3/2007 Schultz ..... 84/613

OTHER PUBLICATIONS

Peterson Tuners, V-SAM Virtual-Strobe Tuner/Audio Tone/Metronome Rhythm, Index, Overview and Instruction Manual, Peterson Elecro-Musical Products, Inc., Revised Mar. 2003, www.petersontuners.com.*

Portable and Customizable Ear Training, Perfectone POrtable Ear Training for Musicians by Samigo Innovations, Homepage, Demos and Users Manuals, Samgo Inovations, Inc., earliest date of website found Feb. 2004, last revised Mar. 2005, www.samigoinnovations.com.*

U.S. Appl. No. 10/282,861, filed Oct. 28, 2002, Robbin, et al.

Jumatek, Inc. "Smart Tools for Smart Musicians" http://www.jumatek.com/ztuner.htm.

Tune Up Systems, "Tune Up: Basic Training" http://www.tuneupsystems.com/website_004.htm.

The Tuning CD, "The Tuning CD Fixes Intonation Fast" http://www.thetuningcd.com.

Smart Music, "Intonation Trainer" http://www.depauw.edu/music/band/itsuggestions.htm.

Make Music, "Your EQ" http://www.youreq.com/musiceq/software/makemusic/intonation-trainer.asp?bhcp+1&bhfv-0&bhas+1.

* cited by examiner 103 105 107

| Interval | Ratio to Fundamental Just Scale | Ratio to Fundamental Equal Temperament |
|---|---|---|
| Unison | 1.0000 | 1.0000 |
| Minor Second | 25/24 = 1.0417 | 1.05946 |
| Major Second | 9/8 = 1.1250 | 1.12246 |
| Minor Third | 6/5 = 1.2000 | 1.18921 |
| Major Third | 5/4 = 1.2500 | 1.25992 |
| Fourth | 4/3 = 1.3333 | 1.33483 |
| Diminished Fifth | 45/32 = 1.4063 | 1.41421 |
| Fifth | 3/2 = 1.5000 | 1.49831 |
| Minor Sixth | 8/5 = 1.6000 | 1.58740 |
| Major Sixth | 5/3 = 1.6667 | 1.68179 |
| Minor Seventh | 9/5 = 1.8000 | 1.78180 |
| Major Seventh | 15/8 = 1.8750 | 1.88775 |
| Octave | 2.0000 | 2.0000 |

102(i)

101

Fig. 1
Prior Art 205 207 209 211

| Note | Just Scale | Equal Temperament | Difference |
|---|---|---|---|
| C4 | 261.63 | 261.63 | 0 |
| C4# | 272.54 | 277.18 | +4.64 |
| D4 | 294.33 | 293.66 | -0.67 |
| E4b | 313.96 | 311.13 | -2.84 |
| E4 | 327.03 | 329.63 | +2.60 |
| F4 | 348.83 | 349.23 | +0.40 |
| F4# | 367.92 | 369.99 | +2.07 |
| G4 | 392.44 | 392.00 | -0.44 |
| A4b | 418.60 | 415.30 | -3.30 |
| A4 | 436.05 | 440.00 | +3.94 |
| B4b | 470.93 | 466.16 | -4.77 |
| B4 | 490.55 | 493.88 | +3.33 |
| C5 | 523.25 | 523.25 | 0 |

203(i)

201

Fig. 2
Prior Art waveform for the chord of
f, 2f, and 3f 601

701

709

INTONATION TRAINING DEVICE

CROSS REFERENCES TO RELATED APPLICATIONS

The present patent application claims priority from U.S. provisional patent application 60/471,668, Richard A. Schwartz, Intonation training apparatus and method, filed May 19, 2003.

BACKGROUND OF THE INVENTION

1. Field of the Invention

The invention relates generally to devices for improving the skills of musicians and more particularly to devices which improve a musician's intonation, that is, the ability of the musician to play a note at the proper pitch.

2. Description of Related Art: FIGS. 1 and 2

The notes musicians play or sing belong to scales. There are many kinds of possible scales; in the one used in Western music, the scale is divided into octaves, with a note that is an octave higher than a given note having exactly twice the frequency of the given note. An octave has 12 notes in it; thus, if the note on which the octave begins (this note is the fundamental), is a C, the notes in the octave are C, C#, D, D#, E, F, F#, G, G#, A, A#, B. This particular scale is called a C chromatic scale. Scales are characterized as belonging to particular keys. A key specifies the fundamental of a scale and the relationship between the notes of the chromatic scale and the intervals of the key. An interval specifies the relationship of the pitch in the key's scale to the pitch of the key's fundamental. A key's name specifies the scale's fundamental and whether the scale is major or minor. The intervals of a major scale are the major second, the major third, the fourth, the fifth, the major sixth, and the major seventh. The key of C major, for example has C as its fundamental and includes the following notes of the C chromatic scale. The interval is in parentheses following the note: C, D(major second), E (major third), F (perfect fourth), G (perfect fifth), A (major sixth), B (major seventh), C (perfect octave).

The intervals of a natural minor scale include the major second, minor third, perfect fourth, perfect fifth, minor sixth, and minor seventh; the key of C minor again has C as its fundamental and includes the following notes of the C chromatic scale: C, D, Eb, F, G, Ab, Bb, C. Important intervals for the present discussion are the minor and major third and the fifth. The perfect fifth may be augmented (C-G# in the key of C major) or diminished (C-Gb).

The actual pitches of the notes in a scale are determined by whether the scale is a just scale or a tempered scale. In a just scale, the ratios between the frequencies of the notes in the scale and the frequency of the fundamental are rational numbers. This is shown in FIG. 1. In table 101, there is a row 102(*i*) in table 101 for each interval; column 103 indicates the row's interval; column 105 shows the ratio of the frequencies of the pitches specified by the interval. A property of just scales is that the pitches of the notes in a key differ slightly from corresponding notes in other keys; for example, the pitch of G in a just C major scale is slightly different from the pitch of G in a just F major scale.

These slight differences between the pitches of the notes in the just scales cause no problems for singers, players of most string instruments, and players of wind instruments, since they can easily adjust the intonation of the notes they sing or play to fit whatever just key they are singing or playing in. There is thus no need for a string or wind player to retune his or her instrument when the key changes. That is not the case with fretted string instruments or keyboard instruments such as harpsichords or pianos. With these instruments, the player cannot adjust the intonation of a string without returning the instrument, and consequently, if the instrument is tuned to the just scale for a key, only music in that key will sound good when played on the instrument. A key change requires that the instrument be returned, and for keyboard instruments, that is a considerable undertaking.

Keyboard instruments become capable of playing music in all keys when they are tuned with a tempered scale. The tempered scale does not sound as good as the just scale for any particular key, but it sounds reasonable in all keys. There are various historical systems for tempering the scales of keyboard instruments. The systems are termed temperaments. The tempering system used in modern keyboard instruments is the equal temperament system. Col. 107 of FIG. 1 compares the ratios between the fundamental and the intervals in the equal temperament system with the ratios used in the just scale. Table 201 of FIG. 2 again has a row 203(*i*) for each interval. The intervals are specified in col. 205. Table 201 compares the frequencies of the notes of a just scale in the key of C (col. 207) with the frequencies of the pitches of the scale beginning at C for a piano that has been tuned according to the equal temperament system (col. 209). Col. 211 gives the difference in Hz between the frequencies of the corresponding notes.

When a keyboard instrument is part of an ensemble, all of the other singers or players must of course adjust to the tempered scale of the keyboard instrument. Otherwise, however, singers and instrumentalists can use the just scale for the key they are currently playing in. The challenge here is developing the intonation skills necessary to correctly play the notes in the just scales for each key. Where there is a correct source for a pitch, a player of a string or wind instrument can determine the quality of his or her intonation by listening for the beat that is produced when two notes having almost the same frequency are sounded together. As the difference between the frequencies of the notes get smaller, the beat gets slower and finally vanishes. Similarly, if a player is playing a note in a chord and the intonation of the note is not correct relative to the other notes in the chord, a beat is produced Again, when the note is played with the correct intonation, no beat is heard.

The phenomenon of beats when a note in a chord is played out of tune has long been used in intonation training, and there are existing intonation training devices that take advantage of the phenomenon. One class of such devices is CDs whose tracks contain chords of pitches belonging to a just scale. In the following discussion, a chord is understood to mean the sound produced by the simultaneous sounding of two or more distinct pitches in a scale. A chord whose pitches belong to a just scale is termed in the following a pure chord. The player who wants to develop his or her intonation selects a track with the desired pure chord and then plays along with the track, adjusting his or her intonation as required to eliminate the beat. The inventor of the present invention has been producing and selling such a CD, called The Tuning CD, since 1998. The Tuning CD is available from The Tuning CD, P.O. Box 1703, Cherry Hill, N.J. 08034-0090. A description of this CD can be found at www.thetuningcd.com; in the Tuning CD, the chords are pure open fifths.

Another example of a CD for intonation training is produced by TuneUp Systems, PO Box 29574, Richmond, Va. 23242. A description of this CD could be found in May, 2004 at www.tuneupsystems.com/website_002.htm Another class of intonation training devices is software that runs on personal computers. A modern personal computer of course includes an audio synthesizer, and when the computer provides digital inputs to the sound board that specify an audio signal to the audio synthesizer, the audio synthesizer generates an audio signal as specified by the inputs. Intonation training software is thus able to cause the audio synthesizer to generate pure chords for intonation training. Examples of such software include the SmartMusic Intonation Trainer, available from MakeMusic, Inc, and the Z-Tuner, available from Jumatek, Inc. A description of the SmartMusic Intonation Trainer software could be found in May, 2004 at www.mccormicksnet.com/intonatn.htm and a description of the Z-Tuner could be found at www.jumatek-.com/ztuner.htm While the CD-based and software-based intonation training devices are perfectly capable of producing the pure chords needed for intonation training, they do have practical drawbacks. To begin with, the devices are not particularly portable. For the CD, you need a CD player; for the software, you need a PC, and even the smallest CD players and laptop PCs are not pocket size. Then there is the matter of the user interface: to use the CD, you need to know which track has which key, and for that you need a description of what's on the CD as well as the CD. The intonation training software has the usual problem with software—namely, it can do anything the user wants, but configuring it to do it is difficult and requires familiarity with the software and with the graphical user interface presented by a modem PC operating system. For example, both the SmartMusic Intonation Trainer and the Z-Tuner provide just scales and can be made to produce chords using pitches of a just scale, but it is up to the user to define for each key the chords he or she wants to use for intonation practice. What is needed, and what is provided by the present invention, is an intonation training device that's as compact, portable, and easy to use as the electronic devices that have long been used to tune musical instruments. It is an object of the present invention to provide such an intonation training device.

SUMMARY OF THE INVENTION

The intonation training device disclosed herein has a user interface that the user may use to specify a key, an audio signal producer, and an audio output. When the user specifies a key in the user interface, the audio signal producer responds to the specified key by producing a sustained audio signal that is a pure chord in the specified key and providing the audio signal to the audio output. The user specifies the key in the user interface by selecting the key from a list of keys and the user interface includes a selector which navigates through the list. The user interface further includes a visual output and the audio signal producer responds to the specified key by producing a visual specification of the specified key and providing the visual specification to the visual output.

The chord may include a pure fifth or a pure third and the user interface may permit the user to specify a pure fifth or a pure third. In such embodiments, the visual output indicates the selected chord.

The user interface may further permit the user to specify a modification of the pure chord and the audio signal producer responds by producing the specified pure chord with the specified modification. In such embodiments, the visual output indicates the specified modification. Modifications include modifying the specified chord's mode (major, minor, augmented, diminished), adding an additional interval to the specified pure code, modifying the specified pure chord's timbre, modifying the octave in which the specified pure chord sounds, and modifying the specified pure chord's calibration frequency.

The intonation training device may be pocket-sized and may be battery powered and further may be implemented in a portable pocket-sized multimedia asset player into which has been downloaded 1. information from which the pure chord corresponding to the specified key may be produced by the multimedia asset player and
2. code which when executed by the multimedia asset player causes the multimedia asset player to provide a user interface wherein a user may specify a key and to respond to the specified key by using the downloaded information to produce a sustained audio signal that is the pure chord in the specified key and providing the sustained audio signal to the multimedia asset player's audio output.

Other objects and advantages will be apparent to those skilled in the arts to which the invention pertains upon perusal of the following Detailed Description and drawing, wherein:

BRIEF DESCRIPTION OF THE DRAWING

FIG. 1 is a table that provides a general comparison of a just scale with an equal temperament scale;

FIG. 2 is a table that provides a comparison of the frequencies of the pitches of a just C-major scale with the frequencies of the corresponding notes in an equal temperament scale;

Figure 3:
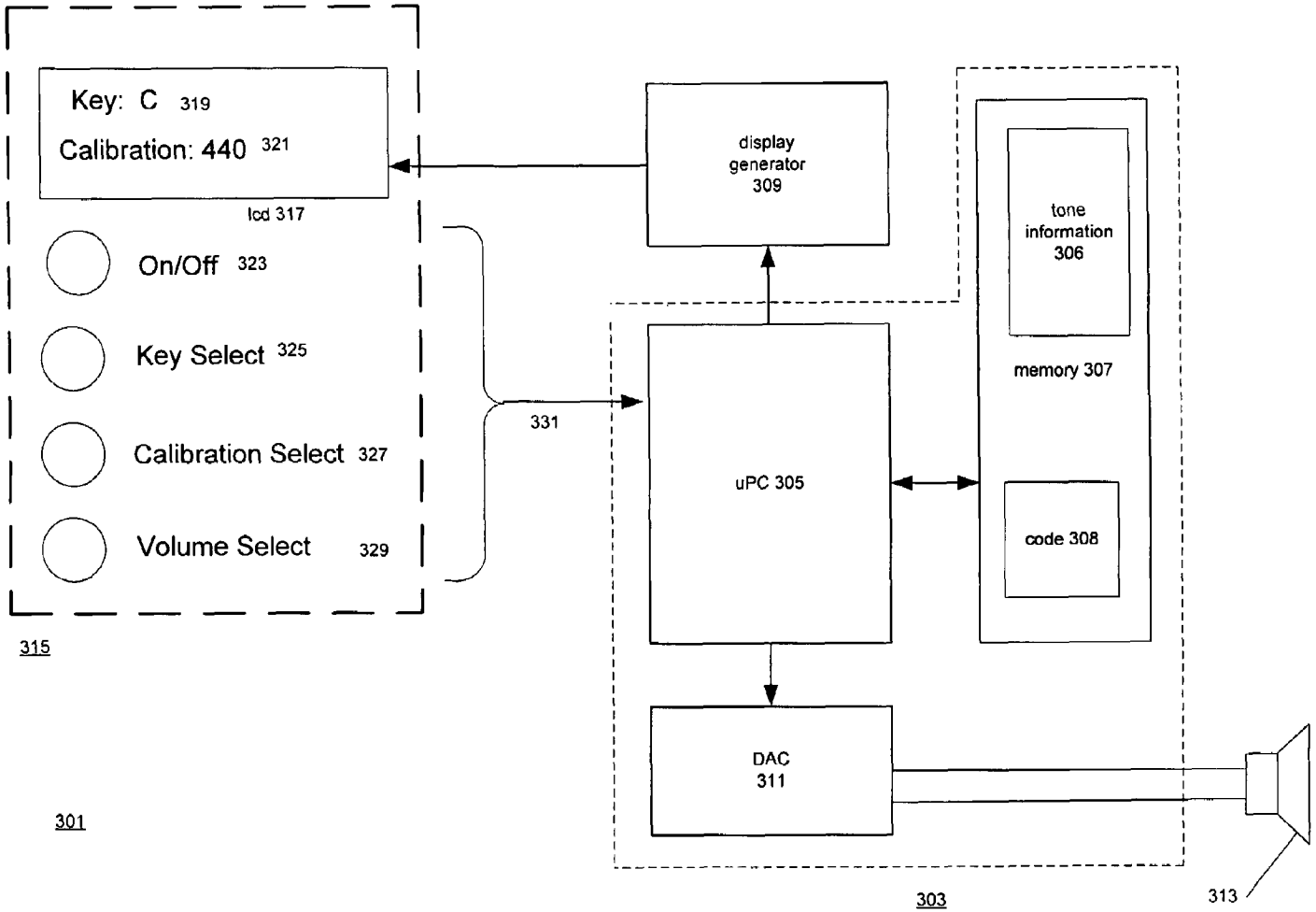
FIG. 3 is an overview of the intonation training device.

Reference numbers in the drawing have three or more digits: the two right-hand digits are reference numbers in the drawing indicated by the remaining digits. Thus, an item with the reference number 201 first appears as item 201 in FIG. 2.

DETAILED DESCRIPTION

The following Detailed Description will first provide an overview of the intonation training device and will then describe three different embodiments of the invention.

Figure 8:
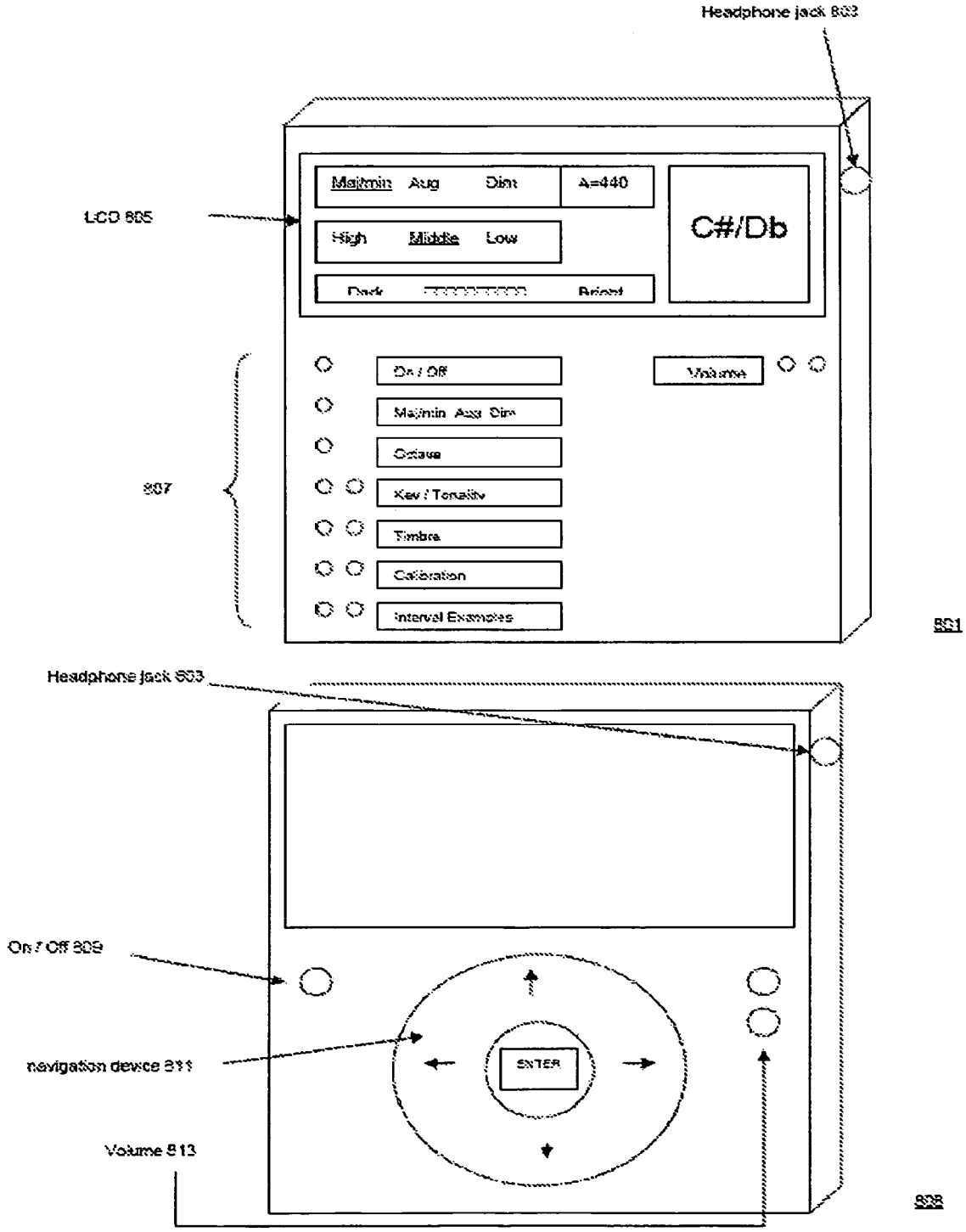
FIG. 8 is a drawing of two versions of the intonation training device's user interface.

Overview of the Intonation Training Device: FIGS. 3 and 8

FIG. 3 is a conceptual block diagram of the intonation training device. Training device 301 includes two main components: an audio signal producer 303 which produces a continuous pure chord on an audio output device such as a loudspeaker or earphone 313 and a user interface 315 which the user employs to control audio signal producer 303. Outputs 331 from user interface 315 go to signal producer 303. In a preferred embodiment, training device 301 is a battery-powered pocket sized device. Beginning with user interface 315, user interface 315 includes a display 317 which is at a minimum able to display alphanumeric characters. In a preferred embodiment, display 317 is a liquid crystal display. User interface 315 further includes a number of control signal activators 323-329 which the user of device 301 uses to control the operation of audio signal producer 303. Activator 323 starts and stops the operation of audio signal producer 303; key select activator 325 selects a key whose pitches are to be used to produce the pure chord; calibration select activator 327 selects the pitch to which the "A" belonging to the just scale of the selected key is to be calibrated. All of the other pitches of the just scale are of course adjusted to the selected pitch of the "A". This kind of calibration is useful because there have been many different historic pitches of the concert "A", and where the historic pitch of a concert "A" is known, that pitch should be used for music that was written to be performed at that pitch. For example, we know from a tuning fork that belonged to Handel that for him, the frequency of the concert A was 423 Hz instead of the 440 Hz. that is generally used now. A musician practicing for a historically correct performance of the Messiah would use the calibration select activator to set the pitch of the "A" to Handel's 423 Hz. Volume select activator 329 sets the volume for the pure chord. The name of the key selected by key select activator 325 appears at 319 in display 317; the frequency of the concert "A" that the key's just scale is calibrated to appears at 321 in display 317.

In a preferred embodiment, activators 325-329 are push-buttons that select items from a list. Thus, when key select button 325 is pressed, it selects the next key on a circular list of keys; similarly, when calibration select button 327 is pressed, it selects the next value for the concert "A" on a circular list thereof, and when volume select 329 is pushed, it selects the next volume level from a circular list thereof. In other embodiments, other activators which are useful for selecting items from a list may be employed and the lists they are selecting from may be displayed in display 317. Examples of such other activators are wheels, sliders and other pointing devices that can indicate that a next item relative to the currently-selected item.

Audio signal producer 303 responds when a user selects a key or calibration by outputting a character string representing the key or calibration to display generator 309, which then produces the output to LCD 317 which is necessary to cause LCD 317 to display the selected key and calibration. Audio signal producer 303 further responds to the currently-selected key and calibration by outputting a chord that is a pure fifth in the currently-selected key as calibrated according to the currently-selected calibration frequency to audio output device 313.

Continuing with details of audio signal producer 303, audio signal producer 303 includes a standard microprocessor 305, standard memory 307, and a digital to analog converter 311 which converts digital representations of sounds to audio signals. Memory 307 contains code 308 which is executed by microprocessor 305 and tone information 306, which is used by microprocessor 305 to produce the digital representations which microprocessor 305 provides to digital-to-analog converter 311. The output from digital to analog converter 311 may go to a speaker or earphone which is an integral part of intonation training device 301 or it may go to a jack into which an earphone or speaker can be plugged.

As will be explained in more detail later, there are two basic kinds of tone information 306: tone information which is a digital sample of the pure fifth in the key specified in display 317 and tone information from which microprocessor 305 can synthesize a digital representation of the pure fifth in the specified key. In either case, the digital sample or synthesized representation is output to digital to analog converter, which produces the audio signal for the fifth and outputs it to speaker 313.

Many variations on the embodiment of intonation training device 301 shown in FIG. 3 are possible. For example, in a version for use in environments where only a single frequency for the concert "A" is used, there may be no need to select a calibration and thus no need for calibration select activator 327. The activators may also include a direction activator which indicates the direction in which movement through a list occurs when button 325, 327, or 329 is pushed. On/off switch may be a power switch or it may by a "chord on/off switch" which would effectively start and stop output from uPC 305 to DAC 311 and permit the user to turn off the output of the current chord, set the calibration and key as desired, and then turn on the new chord. Of course some embodiments may have both a power switch and a chord on/off switch. Display 319 may further display the current settings of all of the activators; for example, the current volume could be indicated by a marker on a scale in display 317, and the direction in which movement through a list is occurring could be indicated by a direction arrow in display 317.

In the preferred embodiment, the pure chord is a pure fifth, and this is indeed the most useful chord for intonation training, but pure thirds are also useful and other embodiments may produce pure thirds or permit the user to select a pure third or a pure fifth. Additionally, other embodiments may permit the user to select an augmented or diminished fifth or a major or minor third. Still others may permit the user to add other intervals to the pure perfect fifth, for example, minor second, major second, minor third, major third, perfect fourth, augmented fourth, diminished fifth, augmented fifth, minor sixth, major sixth, minor seventh, or major seventh. Other characteristics of the pure chord that may be specified in other embodiments include timbre, ranging from dark through light, and the octave of the key in which the chord is to sound.

FIG. 8 shows two different kinds of user interfaces for hand-held battery powered versions of the intonation training device. Version 801 has buttons 807 for selecting the key, the interval, whether the interval is major or minor, the octave, the timbre, the calibration, and other intervals to be added to the perfect fifth. The current setting for each of these characteristics of the chord appears in LCD 805. When a user presses one of buttons 807, the next item in the list of items of that kind to be selected appears in the LCD. Where there are a great number of possible items, there are two buttons, to permit the user to move either up or down the list of items. There are similarly two buttons for setting the volume.

Version 808 offers the same capabilities as version 801, but uses a different type of navigation: navigation device 811. Single navigation device 811 permits the user to specify four different directions of navigation: left, right, up and down. In the preferred embodiment, left and right are used to move through lists of items; up and down are used to move between lists. When an item in a list has been reached, the item can be selected by pushing the "enter" button at the center of the device. Additionally, each of versions 801 and 808 has a headphone jack 803, on on-off button 809, and a volume 813.

Figure 4:
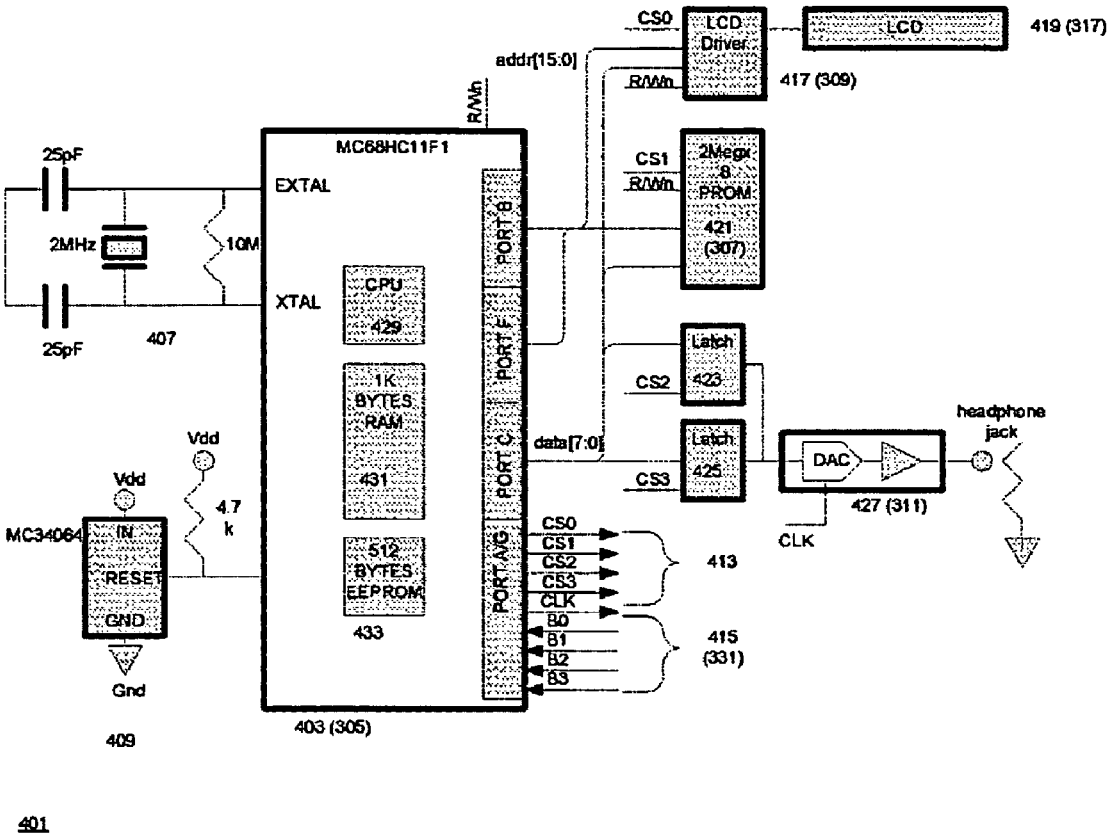
FIG. 4 is a schematic of a first embodiment of the intonation training device.

An Embodiment That Uses Pure Chord Samples: FIG. 4

FIG. 4 shows an embodiment 401 of intonation training device 301 that uses pure chord samples. Elements of FIG. 4 that correspond to elements of FIG. 3 have the corresponding reference numbers from FIG. 3 in parentheses. Embodiment 401 is implemented using a standard 8-bit microcontroller model MC68HC11F1 manufactured by Motorola, Inc. Microcontroller 403 includes CPU 429, internal RAM 431, and 512 bytes of electronically-erasable programmable read only memory 433. Power for system 401 comes from batteries 407; a reset input to microcontroller 403 is provided at 409. Inputs from the actuators in the user interface are received on lines 415; lines 413 are selection lines for devices attached to microcontroller 403. In this case the devices include LCD driver 417, which drives LCD 419, PROM 421, which contains the digital samples, and two latches 423 and 425, which contain the sample from which digital to analog converter 427 is currently producing the audio signal.

Continuing in more detail, multiple implementations of embodiment 401 are possible. The common features are the ability to take push-button inputs in order to adjust the Calibration and the Key. The current settings are displayed on a user display such as a LCD. The device has a headphone jack output through which the pure chord will be played.

The primary user input is via pushbuttons. The pushbutton inputs are described as B0-B3 415 in FIG. 4. There is no specific implementation requirement for the pushbuttons except that they will directly control the output tone that is played.

The microcontroller is the primary controller for the system. It is responsible for accessing all of the external interfaces through an addressing scheme. Each external interface has a unique address map assigned to it and these address "zones" are decoded and identified by the assertion of "chip-select" lines 413 being driven active on the microcontroller. DAC 427 runs off of a synchronous clock. The clock typically runs at 44 kHz.

Some manufacturers offer LCDs with built-in drivers. For simplicity, LCD 419 and driver 417 have been drawn separately but there is no reason why they cannot be combined.

When stored samples of the pure chords are used, the samples are stored in a memory such as a ROM, a hard-drive, or flash memory. In this implementation, microcontroller 403 fetches a digital representation of the pure chord for a given key from memory 421 according to the key specified by the user. This reference tone is placed in the microcontroller's internal memory 431. This local storage mechanism will reduce external memory access and increase battery life. Microcontroller 403 has an 8-bit memory word. However, CD-quality sound requires 16-bits to represent a sound digitally. Consequently, a digital representation that is stored in two 8-bit words in memory 421 and memory 431 must be demuxed into the single 16 bit wide word required by digital to analog converter 427. This is done by placing one of the 8 bit words in latch 423 and the other in latch 425, with converter 427 taking input from both latches simultaneously. The microcontroller will be responsible for the demuxing. Typically, a small output drive stage is required after the DAC before sending the audio signal produced by the DAC to the headphone jack. The timing for writing the digital sample from RAM 431 to latches 423 and 425 is managed by microcontroller 403.

Figure 5:
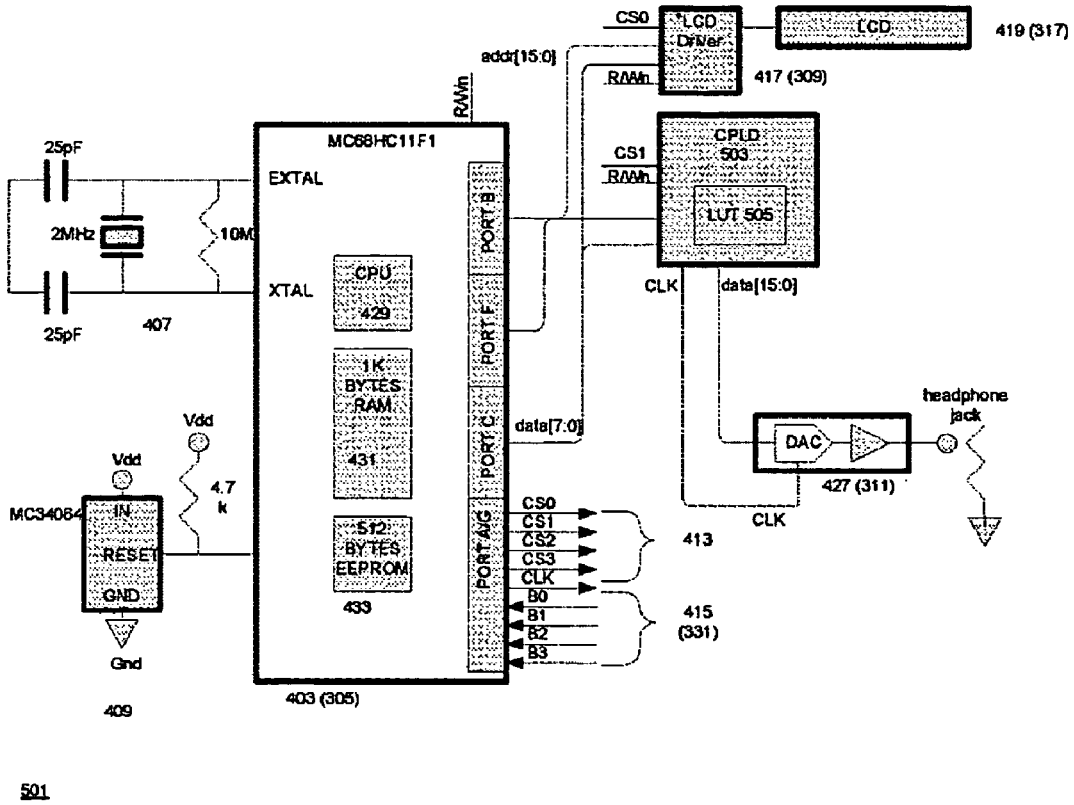
FIG. 5 is a schematic of a second embodiment of the intonation training device.
Figure 6:
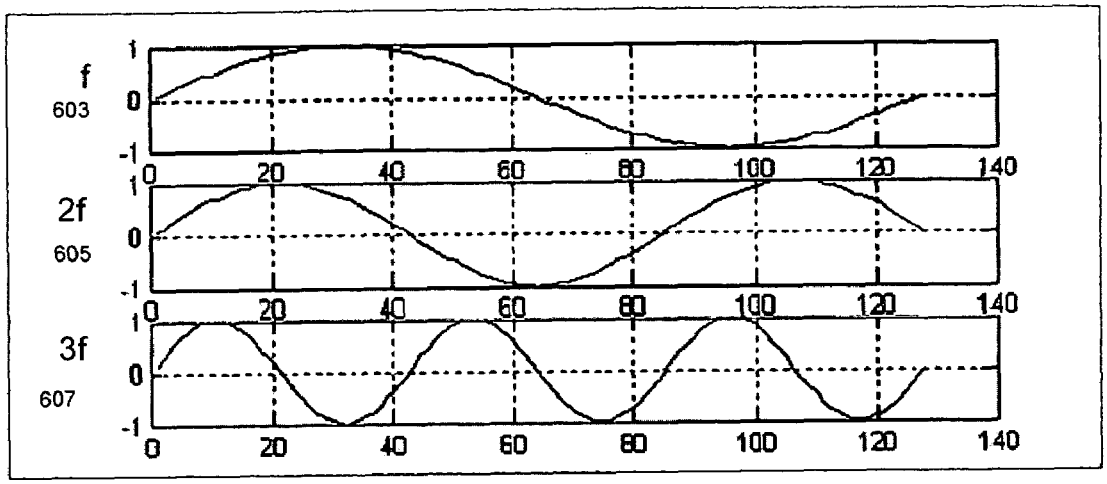
FIG. 6 is a diagram showing how a waveform for a fifth may be determined.
Figure 6:
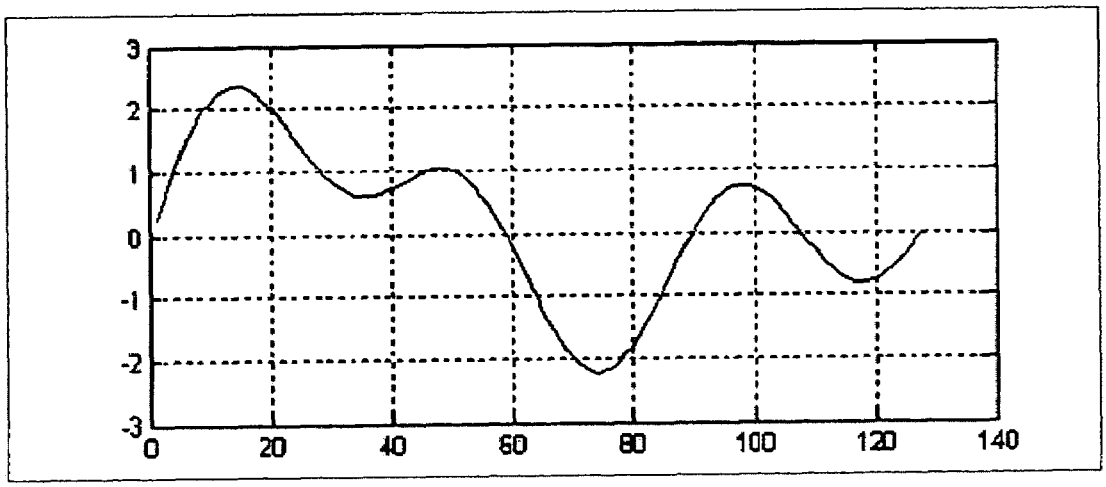
Figure 7:
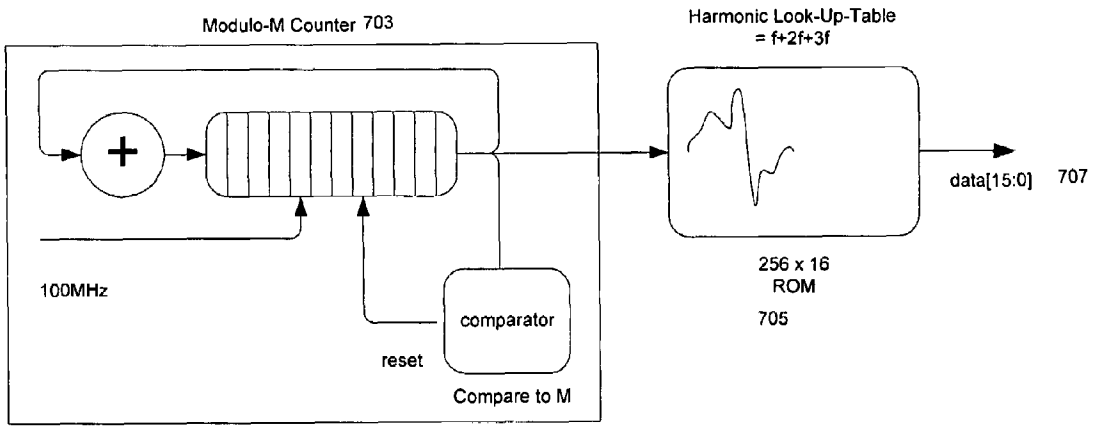
FIG. 7 is a block diagram of an embodiment of the mechanism by which the frequency of a chord is determined in the embodiment of FIG. 5.
Figure 7:
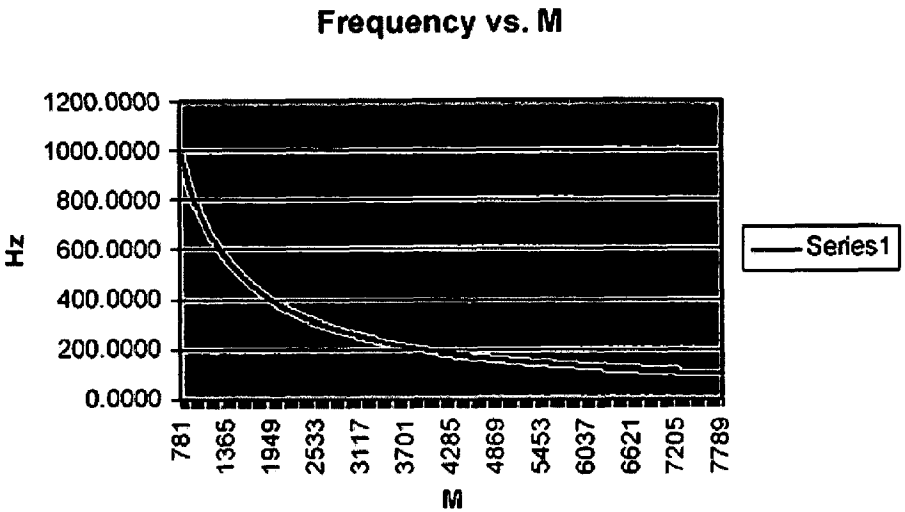

An Embodiment That Generates Pure Chords: FIGS. 5-7

FIG. 5 is a schematic of an embodiment 501 that generates the digital representations of the pure chords on the fly instead of using samples stored in memory. The components of embodiment 501 are in general the same as those of embodiment 401, except that PROM 421, in which samples were stored, and latches 423 and 425, into which the samples were loaded for output to DAC 427, have been replaced by complex programmable logic device (CPLD) 503, which can be programmed by controller 403 to generate digital representations of a pure chord. Controller 403 programs CPLD 503 to generate a pure chord for a particular key upon receiving an input specifying that key from user interface 315. After being thus programmed, CPLD 503 outputs the generated digital representation directly to DAC 427.

Continuing in more detail with embodiment 501, when CPLD 503 is configured, it generates the digital representation from a lookup table (LUT) 505 in CPLD 503 which contains digital samples of a periodic image of the pure chord's waveform. Each entry in the lookup table contains a single digital sample and the samples have the same order in the LUT as they have in the waveform. When an entry of the LUT is selected, it outputs its sample. Consequently, continually selecting each address of the table in order will result in a continuous, and periodic, production of a set of samples for a sound having the pure chord's waveform. The digital samples are output to DAC 427. Depending on the embodiment, the samples in the LUT may be invariant or it may be configured by the microcontroller. For example, in embodiments which permitted the user to select pure chords other than the pure fifth, the microcontroller would respond to the selection of a pure chord by configuring the LUT with the samples required by the waveform of the selected pure chord.

FIG. 6 shows how the digital samples in LUT 505 for the waveform of a pure fifth chord may be determined. As may be seen from table 101 of FIG. 1, the ratio of the frequency of a pure fifth to its tonic is 3/2. Consequently, for a given frequency f603, a pure fifth chord may be made using a second frequency 2f605 which is twice the frequency f and a third frequency 3f607 which is three times the frequency off and 3/2 the frequency of 2f. Amplitude of waveform 601 for the chord at a given point may be found by adding the amplitudes of the waveforms for f, 2f, and 3f at points in those waveforms that correspond to the given point. Values for the amplitude of waveform 601 are then loaded into entries in LUT 505.

By changing the speed at which the table entries are selected for output to DAC 427, the pitch of the chord may be changed. The microcontroller configures the table selection rate to produce the proper pitch for the key and calibration selected by the user. The address rate is controlled with a modulo-M digital counter in the CPLD. Such a counter may be configured by the microcontroller to count up to some number "M", roll over to zero, and start over. Each time the counter rolls over, it produces a signal which is used to select the next entry in LUT 503. Thus, the smaller the value of M, the faster the entries in LUT 503 are read and the higher the frequency of the waveform, as shown in graph 709 of FIG. 7. FIG. 7 also shows a schematic of this arrangement at 701. As seen there, the value of M in modulo-M counter 703 determines the rate at which samples from table 705 are output at 707 to DAC 427.

Getting the desired pitch out of the LUT is a function of a number of parameters. The parameters include the clock rate at which LUT 505 operates, the value of M in the module-M counter, and the number of entries in LUT 505. In a preferred embodiment, LUT 305 has 64 entries. This number of entries provides excellent resolution when the samples are fed to DAC 427 at the DAC's 44 kHz-sampling rate. Smaller LUT sizes can be chosen without a major degradation in performance. The 64 entry LUT operates at a clock rate of 100 MHz. This rate was chosen because the desired range of output frequencies is 100 Hz to 800 Hz, which is the best range for intonation training. Frequencies in this range must have sufficient resolution so that even the best musician can hear no distortion. The trade-offs have been made such that the fundamental frequency generated will have <1 Hz of error within the range of 100 Hz to 1000 Hz.

Implementing the Invention in a Portable Pocket-sized Multimedia Asset Player The development of compressed digital representations of audio and visual media, together with the ever increasing density and ever decreasing price of storage media has led to the development of portable pocket-sized multimedia asset players of the type exemplified by the IPOD™ sold by Apple Computer Inc. and described in U.S. published patent application 2004/055446 A1, Robbin, et al., Graphical user interface and methods of use thereof in a multimedia player, published Mar. 25, 2004 (henceforth "Robbin"), which is hereby incorporated by reference into the present patent application for all purposes. The multimedia assets which the IPOD plays and software for the IPOD may be downloaded to the IPOD from personal computers. Software in the personal computer permits multimedia assets and software for the IPOD to be downloaded from the World Wide Web. In addition to software for playing the multimedia assets, the IPOD includes game software, calendar software, and text notes software.

As disclosed in FIG. 1 of Robbin, the IPOD includes a processor, a storage disk upon which the multimedia assets are stored, a display, a user input device, memory for storing programs and data, cache memory for storing the portion of a multimedia asset currently being played, a decoder for the multimedia, and a speaker. The user interface for the IPOD is disclosed in FIGS. 5A-5E of Robbins. The user interface includes a display upon which a current menu belonging to a hierarchy of menus is displayed and a selection device which includes four selector switches around a rotatable selector wheel and a central button at the center of the wheel. The selector switches specify rewind, play/pause, fast forward, and back up one level in the hierarchy of menus. When the selector wheel is rotated, a highlight is moved from one item in the current menu to the next according to the direction of wheel rotation and when the highlight is on the desired menu item, pushing the center button selects the item. If the menu to which the item belongs is not at the bottom of the hierarchy, selecting the item displays a menu belonging to the next level down from the menu to which the selected item belongs.

The IPOD could easily be made to function as an intonation training device of the kind described herein. What would be required for this would be a software download to the IPOD which included the digital representations of the pure chords and code for adding a user interface for the intonation training device to the IPOD. The digital representations of the pure codes would be stored in the file system. After the software had been installed, the highest level of the IPOD memory hierarchy would contain an "Intonation trainer" entry; selection of that entry would case the user interface to display a second level from which the user could select entries at least for the key and the calibration. Selection of the key entry would cause the user interface to display a list of the keys, and the user could select a key from the list. Selection of the calibration entry would cause display of a list of the frequencies for the concert "A". Additional menus could be used to select chords. When the user had the intonation trainer set up as he or she desired, pushing the play/pause selector switch would cause the IPOD to output the selected chord in the selected key as calibrated according to the selected concert "A". Any portable pocket-sized multimedia asset player to which software could be downloaded could be made to function as an intonation trainer in much the same fashion as described for the IPOD.

CONCLUSION

The foregoing Detailed Description has disclosed how to make and use the intonation training device of the invention to those skilled in the relevant technologies and has further disclosed the best mode presently known to the inventor for making the intonation training device. A number of implementations of the intonation training device and of its user interface have been described in the Detailed Description. Also described have been different pure chords that may be produced by the device as well as a user interface that permits specifying one of a plurality of pure chords. Many possible modifications of the pure chords have also been disclosed, along with a user interface that permits specifying these modifications. It will nevertheless be immediately apparent to those skilled in the relevant technologies that many other versions of the intonation training device and of its functionality are possible. For example, any device which can be programmed to produce audio output and to receive a user input specifying a chord can be used to implement the intonation training device and the device may be of any useful size and may be battery powered or not. Similarly, any kind of user interface can be used which permits the user to select items from a list. Finally, other embodiments may provide for other modifications of the pure chords. For all of the foregoing reasons, the Detailed Description is to be regarded as being in all respects exemplary and not restrictive, and the breadth of the invention disclosed here in is to be determined not from the Detailed Description, but rather from the claims as interpreted with the full breadth permitted by the patent laws.

What is claimed is:

1. An intonation training device comprising:

a portable pocket-sized multimedia asset player into which has been downloaded information from which a pure chord corresponding to a specified musical key may be produced by the multimedia asset player; and code which when executed by the multimedia asset player causes the multimedia asset player to provide a user interface that includes a key specifier which the user employs to specify the musical key and a switch which the user uses to switch the multimedia asset player between an active state and an inactive state and causes the multimedia asset player to respond when the user employs the switch to switch the multimedia asset player into the active state by using the downloaded information to produce a sustained audio signal that is the pure chord of two or more simultaneously-sounded distinct pitches in a scale of the specified key and providing the sustained audio signal to the multimedia asset player's audio output, and remaining in the active state until the user again employs the switch to switch the multimedia asset player into the inactive state, whereupon the multimedia asset player responds by ceasing tot produce the sustained audio signal.

2. The intonation training device set forth in claim 1 wherein:

the key specifier specifies the key by selecting the key from a list thereof.

3. The intonation training device set forth in claim 2 wherein:

the key specifier navigates though the list.

4. The intonation training device set forth in claim 1 wherein:

the user interface includes a visual output; and the audio signal producer further responds to the specified key by producing a visual specification of the specified key and providing the visual specification to the visual output.

5. The intonation training device set forth in claim 1 wherein:

the pure chord includes a pure fifth.

6. The intonation training devices set forth in claim 1 wherein:

the pure chord includes a pure third.

7. The intonation training device set forth in claim 1 wherein:

the user interface further permits the user to specify one of a plurality of pure chords in the specified key; and the sustained audio signal is the specified pure chord in the specified key.

8. The intonation training device set forth in claim 7 wherein:

the plurality of pure chords includes chords that include a pure fifth and a pure third.

9. The intonation training device set forth in claim 7 wherein:

the user interface includes a visual output; and the audio signal producer responds to the specified pure chord by producing a visual specification of the pure chord and providing the visual specification to the visual output.

10. The intonation training device set forth in claim 1 wherein:

the user interface further permits the user to specify a modification of the pure chord; and the sustained audio signal is the specified pure chord with the specified modification.

11. The intonation training device set forth in claim 10 wherein:

the user specifies the modification in the user interface by selecting the modification from a list thereof.

12. The intonation training device set forth in claim 11 wherein:

the user interface includes a selector that navigates though the list.

13. The intonation training device set forth in claim 10 wherein:

the user interface includes a visual output; and the audio signal producer responds to the specified modification by producing a visual specification of the modification and providing the visual specification to the visual output.

14. The intonation training device set forth in claim 10 wherein:

the specified modification is that the pure chord have a particular mode; and the sustained audio signal is the specified pure chord in the specified mode.

15. The intonation training device set forth in claim 14 wherein:

the specified mode is that the pure chord be augmented.

16. The intonation training device set forth in claim 14 wherein:

the specified mode is that the pure chord be diminished.

17. The intonation training device set forth in claim 14 wherein:

the specified mode is that the pure chord be a major chord.

18. The intonation training device set forth in claim 14 wherein:

the specified mode is that the pure chord be a minor chord.

19. The intonation training device set forth in claim 10 wherein:

the modification is an additional interval for the pure chord; and the sustained audio signal is the specified pure chord with the additional interval.

20. The intonation training device set forth in claim 10 wherein:

the specified modification is a timbre for the pure chord; and the sustained audio signal is the specified pure chord in the specified timbre.

21. The intonation training device set forth in claim 10 wherein:

the specified modification is an octave for the pure chord; and the sustained audio signal is the specified pure chord in the specified octave.

22. The intonation training device set forth in claim 10 wherein:

the specified modification is a calibration frequency for the pure chord; and the sustained audio signal is a pure chord made according to the specified calibration frequency.

* * * * *